United States Patent [19]

Diederich, Jr.

[11] Patent Number: 4,617,702

[45] Date of Patent: Oct. 21, 1986

[54] TIE MOUNT

[76] Inventor: Paul W. Diederich, Jr., 633 Hunters Trail, Glendora, Calif. 91740

[21] Appl. No.: 693,098

[22] Filed: Jan. 22, 1985

[51] Int. Cl.[4] ..... B65D 63/10

[52] U.S. Cl. ..... 24/16 PB; 24/17 AP

[58] Field of Search ..... 24/16 PB, 17 AP, 30.5 P, 24/21, 20 R, 282, 284, 457, 458; 248/74.3, 74.4

[56] References Cited

U.S. PATENT DOCUMENTS

| | | | |
|---|---|---|---|
| 550,292 | 11/1895 | Roberts | 24/21 |
| 2,904,294 | 9/1959 | Marygold | 24/16 PB |
| 3,570,497 | 3/1971 | Lemole | 24/16 PB |
| 3,837,047 | 9/1974 | Bunnell | 24/16 PB |
| 3,973,293 | 8/1976 | Noorily | 24/16 PB |
| 4,183,119 | 1/1980 | Stewart et al. | 24/16 PB |
| 4,389,754 | 6/1983 | Sohma | 24/16 PB |
| 4,435,881 | 3/1984 | Yamaguchi et al. | 24/16 PB |

FOREIGN PATENT DOCUMENTS

| | | | |
|---|---|---|---|
| 2505628 | 8/1975 | Fed. Rep. of Germany | 248/74.4 |
| 1447628 | 6/1966 | France | 24/16 PB |
| 1217470 | 12/1970 | United Kingdom | 24/16 PB |

*Primary Examiner*—Victor N. Sakran

*Attorney, Agent, or Firm*—B. F. Spencer

[57] ABSTRACT

An elongated, semi-rigid tie mount is disclosed, composed of polymer material and having a central, rectangular, U-shaped cross-sectional portion. A square or circular disk-shaped head is integrally formed at one end of the tie mount. A thin, rectangular tip portion, or tongue, is integrally formed at the other end of the tie mount. The trough, or bottom, of the central, rectangular, U-shaped portion is provided with a longitudinally extending array of serrated teeth projecting partially upward from the bottom of the trough. A slidable, apertured disk retainer, having a set of downwardly projecting, mating teeth, is disclosed for passage over the tip portion of the tie mount in a direction toward the head of the tie mount. An abrupt step is situated at the junction of the tip portion and the U-shaped cross-sectional portion to provide a stop. The stop serves to prevent the slidable, apertured disk portion from being incorrectly advanced onto the U-shaped cross-sectional portion.

3 Claims, 11 Drawing Figures

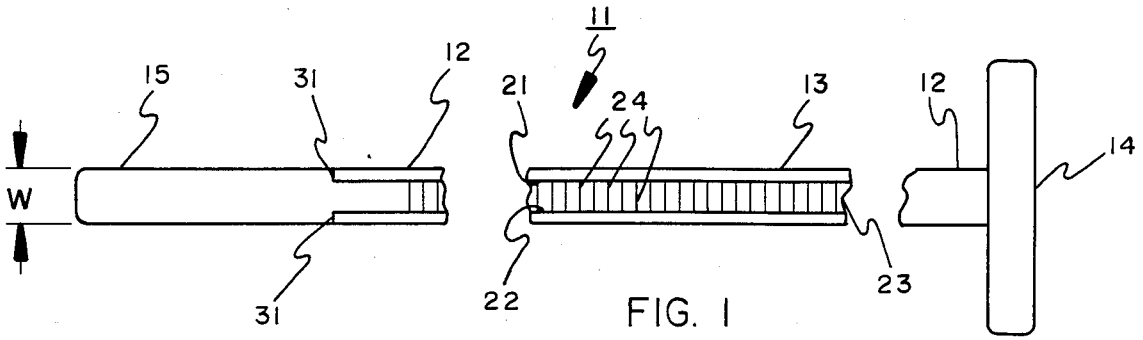
FIG. 1
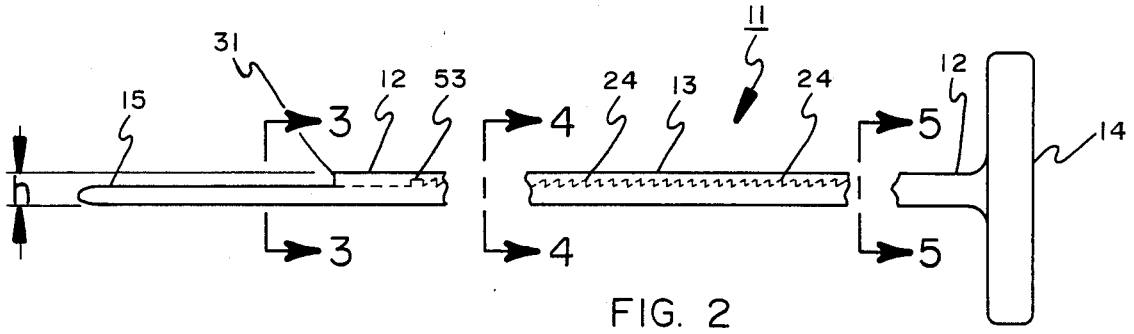
FIG. 2
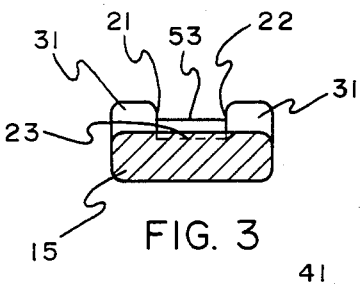
FIG. 3
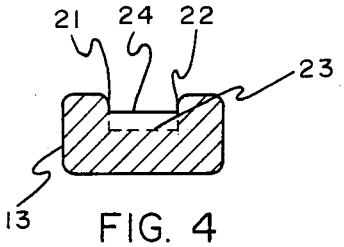
FIG. 4
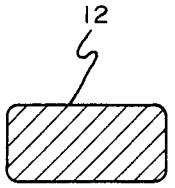
FIG. 5
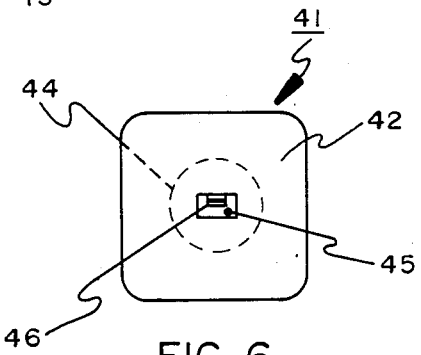
FIG. 6
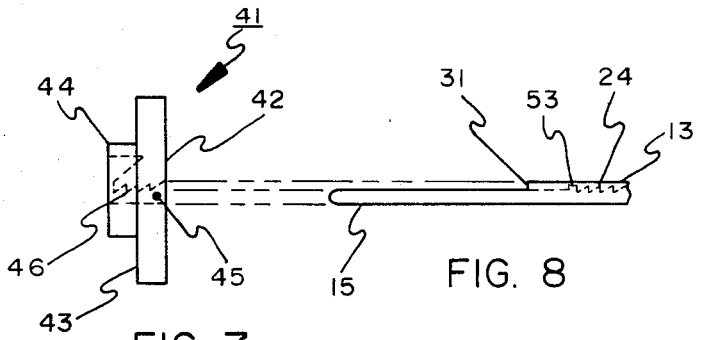
FIG. 7
FIG. 8
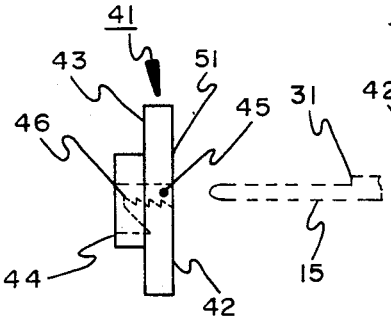
FIG. 9
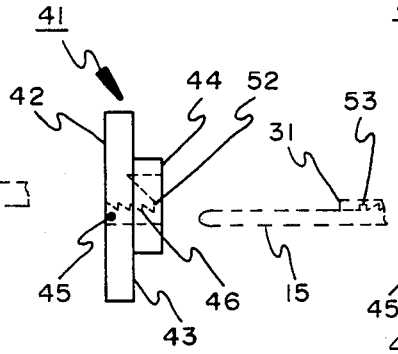
FIG. 10
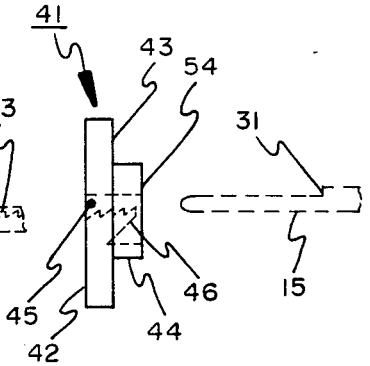
FIG. 11

TIE MOUNT

BACKGROUND OF THE INVENTION

The present invention relates to tie mounts, and, in particular, to elongated, semi-rigid tie mounts of a type having a generally rectangular, U-shaped cross-sectional central portion.

Tie mounts are well-known in the art. One popular type consists of a long, round, slender rod, or shaft, having a disk-shaped head at one end and a smooth rounded tip at the other. Such tie mounts may be composed of metal or plastic and may be said to resemble a long nail or a long knitting needle of the type used in knitting wool garments.

The above-described tie mount is designed to receive over its rounded tip a slidable, apertured spring disk retainer which is forceably slid along the slender rod or shaft in a direction toward the disk-shaped head. The primary function of the tie mount is to retain an object, or a number of objects, compressed between the disk-shaped head and the slidable spring disk retainer.

The apertured spring disk retainer is designed to have a central aperture which consists of a pair of opposing, inclined teeth, the semi-circular biting ends of which define the aperture or opening which slides over the rounded tip and along the length of the long, round, slender rod.

The spring disk retainer must be correctly oriented when placed over the rounded tip of the tie mount to insure that it may be slidably advanced along the length of the rod as the biting teeth of the disk retainer grip the rounded surface of the rod. Any force tending to remove the spring disk retainer, when once secured on the rod, causes the inclined biting teeth to bite into the surface of the rod to resist removal of the retainer. The surface of the long, slender rod may be smooth or it may be serrated or notched.

Another type of tie amount is integrally molded of a plastic or polymer material having a head at one end, a rectangular tip or tongue at the other end and an elongated, generally U-shaped cross-sectional central portion between the head and tongue. A longitudinal array of serrated teeth is situated within the bottom or trough portion of the central U-shaped portion. The array of serrated teeth projects upwardly from the bottom trough and is designed to interlock with a downwardly extending set of teeth molded within a slidable apertured disk retainer.

The present invention pertains to this latter type of integrally molded tie mount, and especially to improvements in such tie mounts, to prevent incorrect and unsatisfactory attachment of the slidable, apertured disk retainer upon the elongated U-shaped cross-sectional central portion.

BRIEF DESCRIPTION OF THE DRAWINGS

FIG. 1 is a top view of the improved tie mount of the invention.

FIG. 2 is a side view of the improved tie mount of FIG. 1.

FIG. 3 is an enlarged cross-sectional view of the tie mount taken along the lines 3—3 of FIG. 2.

FIG. 4 is an enlarged cross-sectional view of the central U-shaped portion taken along the lines 4—4 of FIG. 2.

FIG. 5 is an enlarged cross-sectional view taken along the lines 5—5 of FIG. 2.

FIG. 6 is a front view of the slidable, apertured disk retainer for use with the tie mount of FIGS. 1 and 2.

FIG. 7 is a side view of the slidable, apertured disk retainer of FIG. 6.

FIG. 8 shows the thin, rectangular tip portion, or tongue, of the tie mount of FIGS. 1 and 2 aligned correctly relative to the slideable, apertured disk retainer for entry into the U-shaped aperture of the retainer.

FIGS. 9, 10 and 11 show three different side views of the slidable, aperture disk retainer of FIG. 6, each view illustrating an incorrect orientation of the disk retainer relative to the tie mount for the purpose of illustrating an important feature of the invention.

DESCRIPTION OF THE INVENTION

Referring to FIGS. 1 and 2 of the drawings, the improved tie mount 11 consists of an elongated, semi-rigid shaft member 12 having a central, U-shaped cross-sectional portion 13, a disk-shaped head member 14 integrally attached to the right-hand end of shaft 12, and a thin, rectangular tip portion or tongue 15 integrally formed at the left-hand end of shaft 12. The disk-shaped head member 14 may be either round or square, and the plane defining head member 14 is substantially perpendicular to the longitudinal axis of elongated shaft member 12.

The length of shaft member 12 of a typical tie mount may be as much as 25 to 30 centimeters, and shaft member 12 is shown in sections for purposes of illustration. Shaft member 12 is of rectangular cross-section with a width w, as shown in FIG. 1, approximately fifty percent larger than its height h, as shown in FIG. 2.

The central, U-shaped cross-sectional portion 13 of shaft 12 includes left and right upwardly extending side walls 21 and 22 and a bottom trough 23 as seen in the enlarged views of FIGS. 3 and 4. A longitudinally extending array of serrated teeth 24 is integrally formed upon the bottom trough 23, and these teeth project upwardly from trough 23, as shown in FIGS. 1, 2, 3 and 4.

The array of serrated teeth 24 extends between the left and right side walls 21 and 22, as best seen in FIGS. 1, 3 and 4. The teeth are shaped in a "sawtooth" pattern having a sharp vertically extending edge in the manner of a cog, as seen in the broken lines of the side view of FIG. 2. The upper tips of teeth 24 do not extend as far as the top surface of U-shaped portion 13 but approximately one-half the way up side walls 21 and 22.

The thin, rectangular tip portion 15 does not have a thickness as great as the height h of shaft 12, as best seen in FIG. 2. This results in a step or stop 31 being formed above the point of junction between tip portion 15 and the left-hand end of U-shaped cross-sectional portion 13, as seen in FIG. 2. Step 31 rises vertically from the upper right-hand end of rectangular tip portion 15 and may be defined as the left-hand end of central U-shaped portion 13, as may be seen in FIG. 3. Step 31 may be described as lying in a plane perpendicular to the longitudinal axis of the elongated shaft 12. Step 31 serves to prevent a slidable, apertured disk retainer member from being incorrectly advanced onto the central U-shaped portion 13, as will be described below.

FIG. 5 illustrates the rectangular cross-sectional view of the right-hand end of shaft 12 to which the circular or square head 14 is attached.

Referring to FIGS. 6 and 7, a slidable, apertured disk retainer 41, having a flat front surface 42, a rear surface 43 and a central, circular member 44 extending from the rear surface 43, is provided with a centrally located U-shaped opening or aperture 45 passing completely through retainer 41. A set of three or four serrated teeth 46 project partially downward in an inclined manner into centrally located U-shaped aperture 45, as shown. The width and height of U-shaped aperture 45 is dimensioned to receive the central, U-shaped cross-sectional portion 13 of tie mount 11. The downwardly projecting serrated teeth 46 are dimensioned to interlock with the upwardly projecting serrated teeth 24 located within central, U-shaped cross-sectional portion 13.

Slidable, apertured disk retainer 41 is correctly oriented and aligned, as shown in FIG. 7, to receive and slide over thin, rectangular tip portion 15 of tie mount 11, as illustrated in adjacent FIG. 8. Tip portion 15 enters the lower portion of U-shaped aperture 45 below the set of serrated teeth 46. The step 31 of tie mount 11 passes through the left and right aperture portions of U-shaped aperture 45 on each side of the downwardly projecting set of serrated teeth 46. Apertured disk retainer 41 may be further advanced or slid over tie mount 11 as the set of serrated teeth 46 properly engage, in interlocking fashion, with the serrated teeth 24 situated within central, U-shaped cross-sectional portion 13. Once the set of serrated teeth 46 of disk retainer 41 engages in interlocking fashion with the serrated teeth 24 of central U-shaped portion 13, disk retainer 41 cannot be withdrawn from tie mount 11. Since central U-shaped portion 13 substantially fills the entire U-shaped aperture 45, attempts to twist or distort the shape of U-shaped portion 13 with respect to disk retainer 41, in an attempt to withdraw tie mount 11 from disk retainer 41, will not be successful. A superior interlock between retainer and tie mount is thus achieved. This has not always been the case with certain of the molded prior art plastic tie mounts.

In the event a user of improved tie mount 11 of FIGS. 1 and 2 were to attempt to place apertured disk retainer 41 over tip portion 15 and onto central U-shaped portion 13, as illustrated in FIG. 9, he would discover that a tip portion 15 passes through U-shaped aperture 45 and above the set the serrated teeth 46, the step 31 would be brought abruptly against the flat portion 51 of front surface 42 of apertured disk retainer 41. Step 31 thus serves as a stop, preventing entry of U-shaped portion 13 of tie mount 11 into the U-shaped aperture 45 of disk retainer 41. It should be noted that the side view of disk retainer 41 in FIG. 9 is inverted from that shown in FIG. 7.

If an attempt is made to place apertured disk retainer 41 over tip portion 15 and onto central U-shaped portion 13 of tie mount 11, as illustrated in FIG. 10, it will be found that the blunt end 52 of the last tooth of the set of serrated teeth 46 will abut a stop 53 formed in front of the first tooth of the array of serrated teeth 24 situated within U-shaped portion 13. Stop 53 serves to prevent entry of U-shaped portion 13 into the U-shaped aperture 45 of disk retainer 41. It will be observed that the side view of disk retainer 41 in FIG. 10 is reversed from that shown in FIG. 7.

Should an attempt be made to insert tip portion 15 of tie mount 11 into and through U-shaped aperture 45, as shown in FIG. 11, it will be found that step 31 will abut the rear portion 54 of the central, circular member 44 extending from rear surface 43 of disk retainer 41. Step 31 serves as a stop to prevent entry of U-shaped portion 13 into the U-shaped aperture 45 of disk retainer. The side view of disk retainer 41 in FIG. 11 is inverted from that shown in FIG. 10. It is thus apparent that correct assembly of disk retainer 41 upon the improved tie mount 11 of the invention can only be achieved by the correct orientation of disk retainer 41 relative to U-shaped portion 13 of tie mount 11, as illustrated in FIGS. 7 and 8.

The improved tie mount of the invention may be integrally molded of any suitable material, either metal or polymer, and nylon has been found to be preferred material. A typical tie mount, molded of nylon, may have a width w of from four to five millimeters, a height h of from two and one-half to three millimeters and a tooth depth of approximately one millimeter. The rise of step 31 may be in the vicinity of one and one-half to two millimeters.

Since many changes may be made in the above-described apparatus and many different embodiments of this invention could be made without departing from the scope thereof, it is intended that all matter contained in the above description or shown in the accompanying drawings shall be interpreted as illustrative and not in a limiting sense.

I claim:

1. A tie mount adapted for use with a slidable, apertured disk retainer comprising in combination:

(a) an elongated, semi-rigid shaft member having a central, U-shaped cross-sectional portion;

(b) a disk-shaped head member integrally formed at one end of said elongated shaft member, said disk-shaped head member lying in a plane substantially perpendicular to the longitudinal axis of said elongated shaft member;

(c) a thin, rectangular tip portion integrally formed at the other end of said elongated shaft member, the central U-shaped cross-sectional portion of said elongated shaft member being situated between said disk-shaped head member and said thin, rectangular tip portion, the central U-shaped cross-sectional portion having upwardly extending side walls and a bottom trough;

(d) a longitudinally extending array of transvese serrated teeth integrally formed upon the bottom trough of and extending between the side walls of the central, U-shaped cross-sectional portion, the tips of said longitudinally extending array of teeth projecting upward from the bottom trough and terminating at a position approximately midway up the side walls of the central, U-shaped cross-sectional portion; and (e) stop means situated at the junction of said thin, rectangular tip portion and the central, U-shaped cross-sectional portion of said elongated shaft member, said stop means being defined as a plane substantially perpendicular to the longitudinal axis of said elongated shaft member as formed by the end of the upwardly extending side walls of the central, U-shaped cross-sectional portion.

2. The tie mount as defined by claim 1 wherein said elongated, semi-rigid shaft member, said disk-shaped head member, said thin, rectangular tip portion and said longitudinally extending array of serrated teeth are integrally molded of polymer material.

3. The tie mount as defined by claim 2 wherein said polymer material is nylon.

* * * * *